US009683802B2

(12) United States Patent
Geissele

(10) Patent No.: US 9,683,802 B2
(45) Date of Patent: Jun. 20, 2017

(54) MUZZLE BRAKE

(71) Applicant: WHG Properties, LLC, North Wales, PA (US)

(72) Inventor: William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 14/698,383

(22) Filed: Apr. 28, 2015

(65) Prior Publication Data

US 2016/0178306 A1 Jun. 23, 2016

Related U.S. Application Data

(63) Continuation-in-part of application No. 29/512,552, filed on Dec. 19, 2014, now Pat. No. Des. 754,275, and a continuation-in-part of application No. 29/515,219, filed on Jan. 21, 2015, now Pat. No. Des. 759,188.

(51) Int. Cl.
*F41A 21/36* (2006.01)

(52) U.S. Cl.
CPC ..... *F41A 21/36* (2013.01)

(58) Field of Classification Search
CPC ..... F41A 21/34–21/38
See application file for complete search history.

(56) References Cited

U.S. PATENT DOCUMENTS

| | | | | |
|---|---|---|---|---|
| 2,206,568 | A * | 7/1940 | Hughes | F41A 21/36 89/14.3 |
| 2,442,382 | A | 6/1948 | Sieg | |
| 2,451,514 | A | 10/1948 | Sieg | |
| D158,792 | S | 5/1950 | Powell | |
| D158,794 | S | 5/1950 | Powell | |
| 2,796,005 | A * | 6/1957 | Shapel | F41A 21/36 89/14.3 |
| 3,492,912 | A * | 2/1970 | Ashbrook | F41A 21/36 181/223 |
| 4,643,073 | A * | 2/1987 | Johnson | F41A 21/36 89/14.3 |
| 5,476,028 | A | 12/1995 | Seberger | |
| 5,596,161 | A | 1/1997 | Sommers | |
| 6,752,062 | B2 | 6/2004 | Vais | |
| 7,861,636 | B1 | 1/2011 | Hoffman | |
| 7,905,170 | B1 * | 3/2011 | Brittingham | F41A 21/325 89/14.2 |
| D666,687 | S | 9/2012 | Nierenberg | |
| D692,086 | S | 10/2013 | Nierenberg | |
| D694,355 | S | 11/2013 | Hormann | |
| D711,491 | S | 8/2014 | Nierenberg | |

(Continued)

FOREIGN PATENT DOCUMENTS

GB 479107 A * 1/1938 ..... F41A 21/36

*Primary Examiner* — Stephen M Johnson
*Assistant Examiner* — Joshua Semick
(74) *Attorney, Agent, or Firm* — Merchant & Gould, P.C.

(57) ABSTRACT

A muzzle brake for reducing the recoil associated with firing a weapon comprising a plurality of gas vents, a plurality of projections extending outward from the muzzle brake, and an interiorly depressed annular nose surrounding the projectile's exit point, for capturing, redirecting, and/or creating turbulence in propellant gases generated from firing the weapon.

22 Claims, 13 Drawing Sheets

(56) References Cited

U.S. PATENT DOCUMENTS

| | | | | |
|---|---|---|---|---|
| D729,894 | S | 5/2015 | DeLuca | |
| 9,228,789 | B1 * | 1/2016 | Oglesby | F41A 21/36 |
| 2010/0224054 | A1 * | 9/2010 | Langner | F41A 21/34 89/14.3 |
| 2010/0282056 | A1 | 11/2010 | Hung | |
| 2011/0271575 | A1 | 11/2011 | Overbeek Bloem | |
| 2012/0048100 | A1 | 3/2012 | Davies | |

* cited by examiner

MUZZLE BRAKE

CROSS-REFERENCE TO RELATED APPLICATION(S)

This application is a continuation-in-part of U.S. patent application Ser. No. 29/512,552 (now U.S. Pat. No. D754,275) filed Dec. 19, 2014 (now U.S. Pat. No. D754,427) and a continuation-in-part of U.S. patent application Ser. No. 29/515,219 (now U.S. Pat. No. D759,188) filed Jan. 21, 2015 the disclosures of which are hereby incorporated by reference in their entireties.

BACKGROUND

A common problem associated with shooting firearms is the tendency for the firearm to recoil or kick as a result of rapid expansion and propulsion of gases from the firearm during and after firing. The forces and torque generated by propellant gas during firing generally push the muzzle back toward the shooter and/or upward, forcing the shooter to adjust and re-aim after every shot, thereby making it extremely difficult or impossible to engage in accurate rapid fire. Recoil can also be painful or uncomfortable for the shooter. In an automatic, simulated automatic, or semi-automatic weapon, the recoil phenomenon is compounded, as the muzzle will recoil incrementally with each shot, causing the barrel to move farther and farther (or "walk") away from the target.

SUMMARY

In general terms, this disclosure is directed to a muzzle brake for a firearm. In one possible configuration, and by non-limiting example, the muzzle brake includes a body portion having an internal bore and a plurality of gas vents, and a plurality of projections extending outward from the body portion.

One aspect a muzzle brake comprising a nose at a front end of the muzzle brake, a mounting portion at a back end of the muzzle brake, a body portion between the nose and the mounting portion that tapers towards the nose, the body portion comprising an internal bore and a plurality of gas vents, and a plurality of projections, wherein each projection of the plurality of projections extends outward from the body portion.

Another aspect is a muzzle brake comprising a nose at a front end of the muzzle brake, the nose comprising a depressed surface interior to the muzzle brake, a mounting portion at a back end of the muzzle brake, and a body portion between the nose and the mounting portion that tapers towards the nose, the body portion comprising a substantially hollow internal bore and a plurality of gas vents, each of the plurality of gas vents being defined by a frame comprising a top frame member, a bottom frame member, and a back frame member behind the gas vent, the back frame member being angled outward from the body portion of the muzzle brake.

A further aspect is a method of manufacturing a muzzle brake comprising: providing a mold for a muzzle brake, wherein the mold comprises a plurality of air-powered slides and the muzzle brake comprises a nose, a mounting portion, a body portion comprising an internal bore between the nose and the mounting portion and a plurality of gas vents, each of the plurality of gas vents being defined by a frame comprising a top frame member, a bottom frame member, and a back frame member behind the gas vent, the back frame member being angled outward from the body portion of the muzzle brake, the muzzle brake further comprising a plurality of projections extending outward from the body portion; injecting liquid wax into the muzzle brake mold; allowing the liquid wax to solidify in the muzzle brake mold; retracting the air-powered slides from the muzzle brake mold to open the plurality of gas vents and create the frames; extracting the solid wax from the muzzle brake mold; coating the extracted solid wax in ceramic to create a ceramic muzzle brake mold; melting the wax out of the ceramic muzzle brake mold; and pouring molten metal into the ceramic muzzle brake mold to cast a muzzle brake.

DETAILED DESCRIPTION

Figure 1:
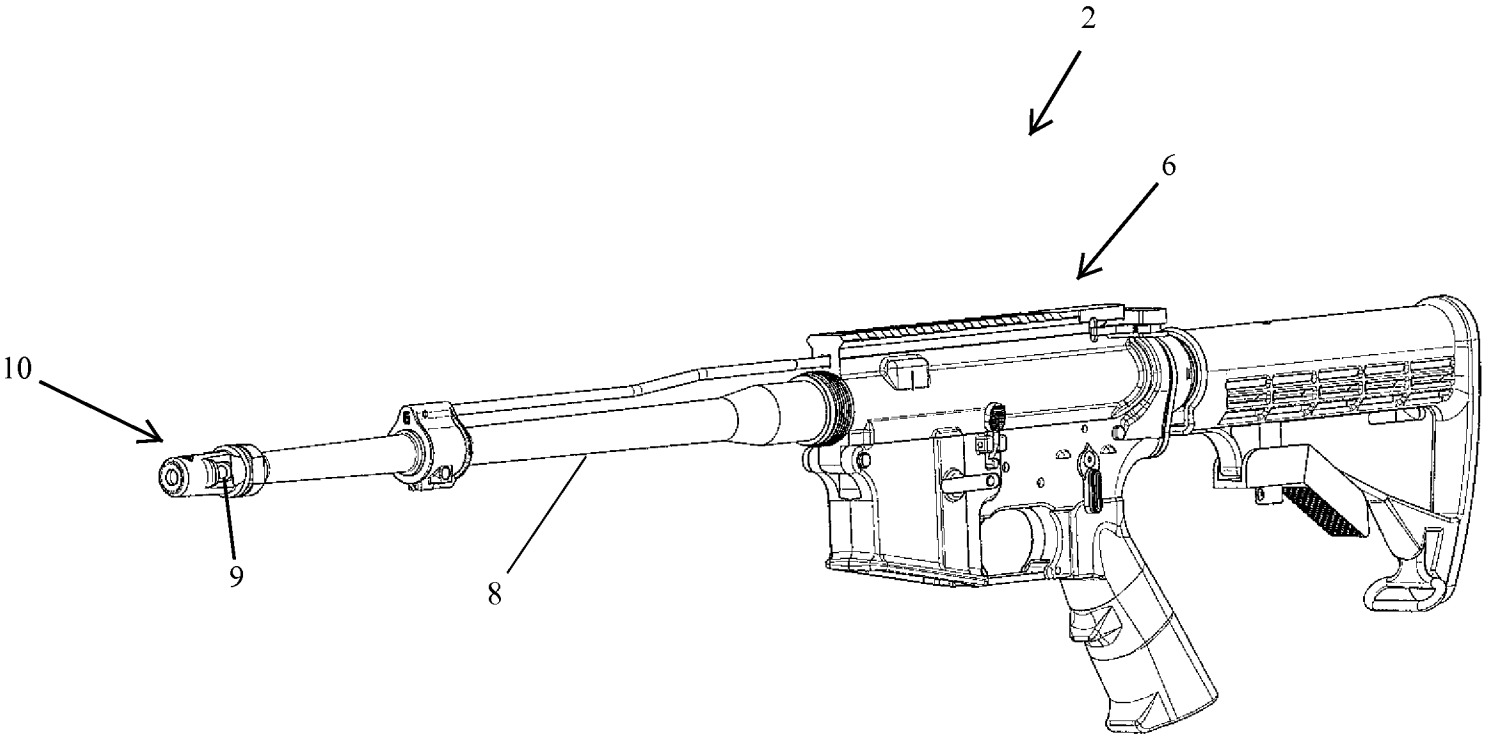
FIG. 1 is a schematic perspective view of an example of a muzzle brake in accordance with the present disclosure mounted on a firearm muzzle.

Various embodiments are described herein in detail with reference to the drawings, wherein like reference numerals represent like parts and assemblies throughout the several views. Reference to various embodiments does not limit the scope of the appended claims. Additionally, any examples set forth in this specification are not intended to be limiting and merely set forth some of the many possible embodiments for the appended claims.

FIG. 1 is a schematic perspective view of a firearm 2. In this example, the firearm 2 includes a receiver 6, a barrel 8 having a muzzle end 9, and a muzzle brake 10.

In some embodiments the firearm 2 is a gun that fires a projectile, such as a bullet. The firearm 2 can be of a variety of types including at least handguns and rifles. The firearm can also have one of a variety of different types of actions, including single action, semi-automatic, fully automatic, or a combination.

The firearm 2 typically includes a receiver 6 that includes various mechanical components of the firearm, such as a trigger mechanism and other parts depending on the particular type and action of the firearm.

The barrel 8 is connected to and extends from a front end of the receiver 6. The barrel 8 has a hollow bore through which the projectile can be fired. The barrel 8 guides the projectile toward the muzzle end 9 of the barrel where it exits the barrel 8 and begins traveling along a flight path toward its target.

The muzzle brake 10 is connected to and extends from the muzzle end 9 of the barrel 8. In at least some embodiments the muzzle brake 10 operates to capture at least some of the expanding gas created during firing at the muzzle end 9 of the barrel 8 and to create turbulence and/or redirect the gas. In doing so, the muzzle brake 10 provides, in at least some embodiments, at least one of a forward and a downward force to the muzzle end 9 of the firearm 2, which functions to counter the rearward and upward recoil forces generated in the firearm 2. To do so, the muzzle brake 10 is typically affixed to the muzzle end 9 of the barrel 8 and aligned with the long axis of the barrel 8. Turbulence, as well as redirecting expanding gas away from the long axis of the barrel 8 and/or towards the shooter tends to balance and neutralize axial recoil (i.e. recoil along the barrel toward the shooter), while turbulence, as well as redirecting expulsion of the gas upwards, tends to reduce the upward kick at the muzzle end 9 of the barrel 8.

Figure 2:
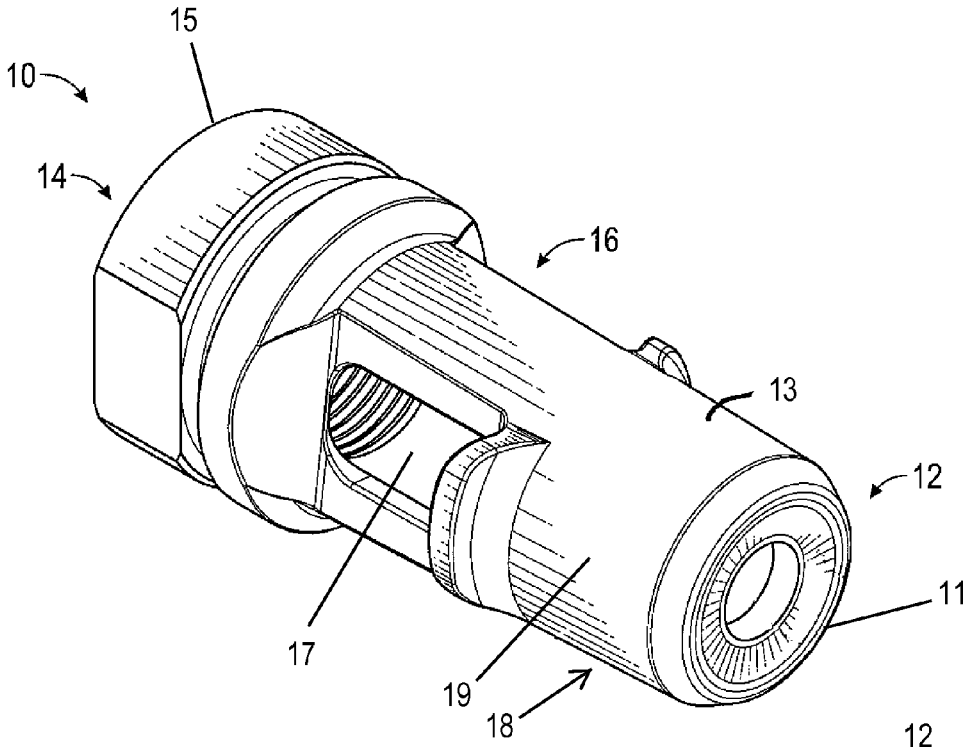
FIG. 2 is a top, front end isometric view of an example of a muzzle brake in accordance with the present disclosure.

FIG. 2 is a top, front end isometric view of an example of a muzzle brake 10 in accordance with the present disclosure. In this example, the muzzle brake 10 includes a front end 11, a nose portion 12, a body portion 13, a mounting portion 14, a back end 15, and an internal bore 17. In some embodiments the body portion 13 includes an exterior surface 19 having a top surface 16 and a bottom surface 18.

In this example the muzzle brake 10 includes the front end 11, and a back end 15 opposite the front end 11.

The nose portion 12 is arranged at and extends rearward from the front end 11 of the muzzle brake 10. The nose portion 12 includes an opening formed therein through which the projectile can pass after being fired by the firearm 2.

The body portion 13 extends between the nose portion 12 and the mounting portion 14. In some embodiments the body portion 13 has a substantially tubular shape, such as having a substantially circular exterior cross-sectional shape, but for the gas vents and projections discussed below. Other embodiments have differently shaped body portions, such as having flat exterior surfaces, such as forming a square or hexagonal cross-section, or another shape. The term "substantially" includes both configurations that are precisely matching and configurations that are mostly, but not exactly, matching. For example, a substantially tubular body portion includes shapes that are entirely tubular and shapes that are mostly, but not entirely, tubular.

In some embodiments the body portion 13 includes an exterior surface 19 having a top surface 16, a bottom surface 18, and an internal bore 17. In the illustrated example, the exterior surface 19 has a circular cross-sectional shape, such that the top and bottom surfaces 16 and 18 are curved. The internal bore 17 also has a circular cross-sectional shape defining a substantially hollow internal passageway through which the projectile (e.g., a bullet) can pass upon firing of the firearm 2, such as shown in FIG. 1, to which the muzzle brake 10 is mounted. Throughout this application, it should be understood that both of the terms "substantially hollow" and "hollow" include both entirely hollow configurations, and configurations that are mostly, but not necessarily entirely, hollow.

Figure 3:
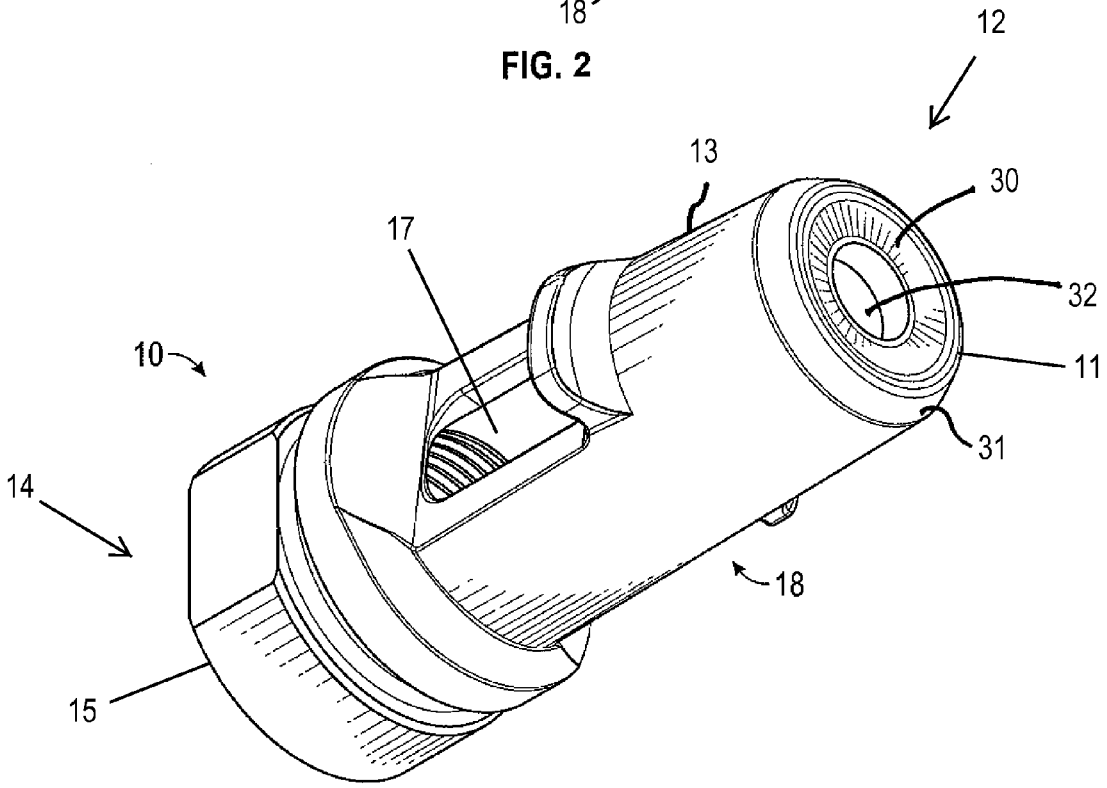
FIG. 3 is a bottom, front end isometric view of the muzzle brake of FIG. 2.

FIG. 3 is a bottom, front end isometric view of the example muzzle brake 10 shown in FIG. 2. As discussed above, the example muzzle brake 10 includes the front end 11, the nose portion 12, the body portion 13, the mounting portion 14, the back end 15, and the internal bore 17. Additionally, in this example the nose portion 12 includes a depressed region 30, a chamfer 31, and an opening 32.

In some embodiments, the nose portion 12 of the muzzle brake 10 includes an annular depressed region 30 and an opening 32.

The annular depressed region 30 is formed at the front end 11 of the muzzle brake 10 and has a slightly tapered surface in some embodiments, which guides the ejected gases outward away from the opening 32.

The opening 32 is in open communication with the internal bore 17 of the body portion 13. In this example, an annular outside edge of annular depressed region 30 has a chamfer 31 to avoid forming sharp angles or edges.

An interior configuration of the nose portion 12 is illustrated and described in more detail with reference to FIG. 12.

Figure 4:
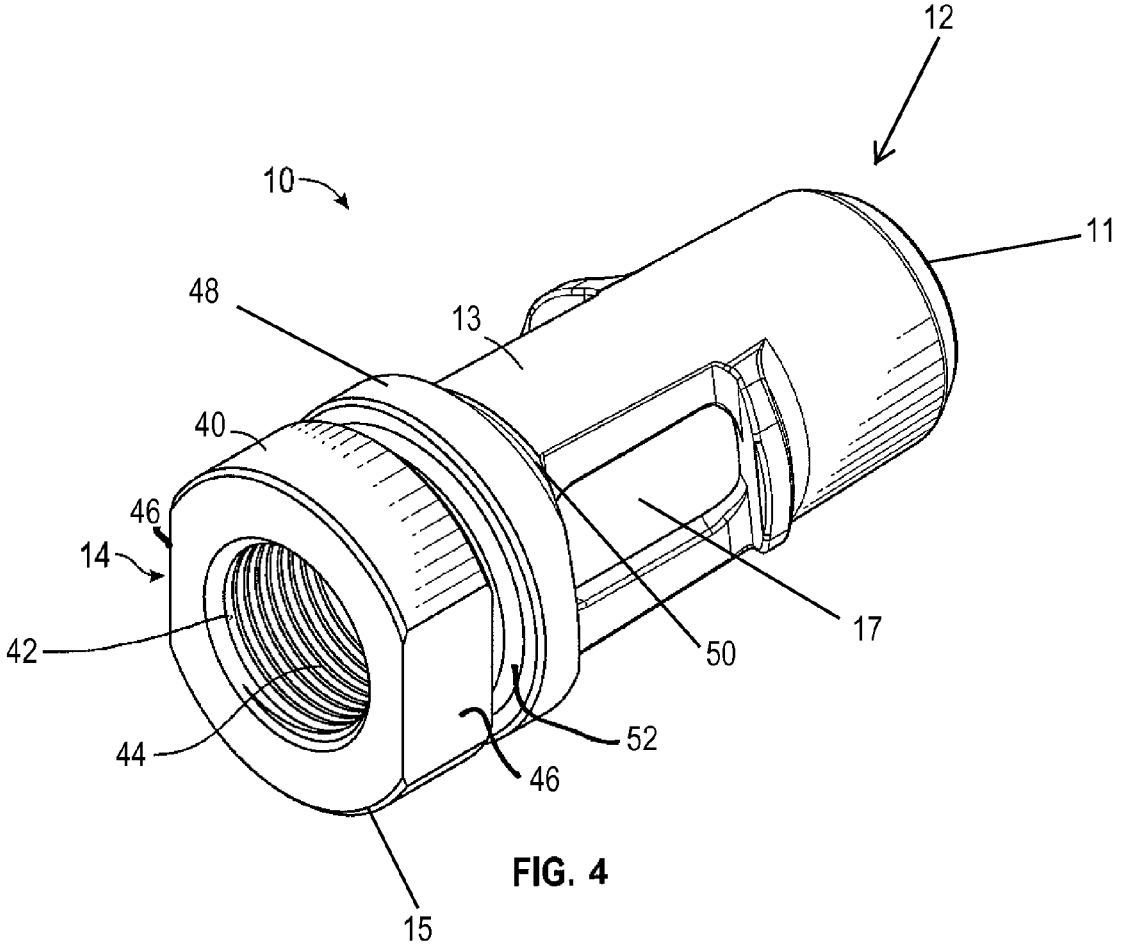
FIG. 4 is top, back end isometric view of the muzzle brake of FIG. 2.

FIG. 4 is a top, back end isometric view of the example muzzle brake shown in FIG. 2. As discussed above, the example muzzle brake 10 includes the front end 11, the nose portion 12, the body portion 13, the mounting portion 14, the back end 15, and the internal bore 17. Additionally, in this example the mounting portion 14 includes a muzzle engagement part 40, opening 42, screw threads 44, flattened sides 46, annular shoulder 48, chamfer 50, annular groove 52, and top 54 of the muzzle engagement part 40.

Muzzle engagement part 40 engages the muzzle end of the barrel of a firearm to secure the example muzzle brake 10 to the firearm. To secure the muzzle brake 10 to the firearm, opening 42 is placed over the muzzle end of the firearm barrel. Screw threads 44 are internal to the muzzle engagement part 40 and mate with corresponding screw threads on the muzzle end of the firearm barrel.

Opening 42 is in open communication with, and extends without interruption through mounting portion 14 and through to the internal bore 17 of body portion 13.

Flattened sides 46 of muzzle engagement part 40 facilitate mounting of the muzzle brake 10 to the muzzle end of the firearm barrel. The muzzle brake can be mounted on the muzzle end of a firearm with any suitable tool, for example with a wrench. By way of example, a wrench can grasp the flattened sides 46 of muzzle engagement part 40 to facilitate mounting of the muzzle brake on the muzzle end of the firearm barrel. In some embodiments, the muzzle engagement part of the muzzle brake may have more or fewer flattened sides.

Annular shoulder 48 is at the forward end of mounting portion 14. The forward edge of annular shoulder 48 has a chamfer 50. Chamfer 50 creates a gradual transition from the relatively wider mounting portion 14 to the relatively narrower body portion 13 of muzzle brake 10 to avoid forming sharp angles or edges.

Annular groove 52 in the example muzzle brake 10 is situated between muzzle engagement part 40 and annular shoulder 48 and corresponds to a reduction in the amount of metal necessary to manufacture muzzle brake 10, thereby additionally reducing the weight of the muzzle brake Annular groove 52 also facilitates grasping the muzzle engagement part 40 of the muzzle brake 10 with suitable mounting tools.

In alternative examples of a muzzle brake in accordance with the present disclosure, the muzzle brake is mounted by alternative means (e.g. without screw threads), as will be apparent to those having skill in the art.

Figure 5:
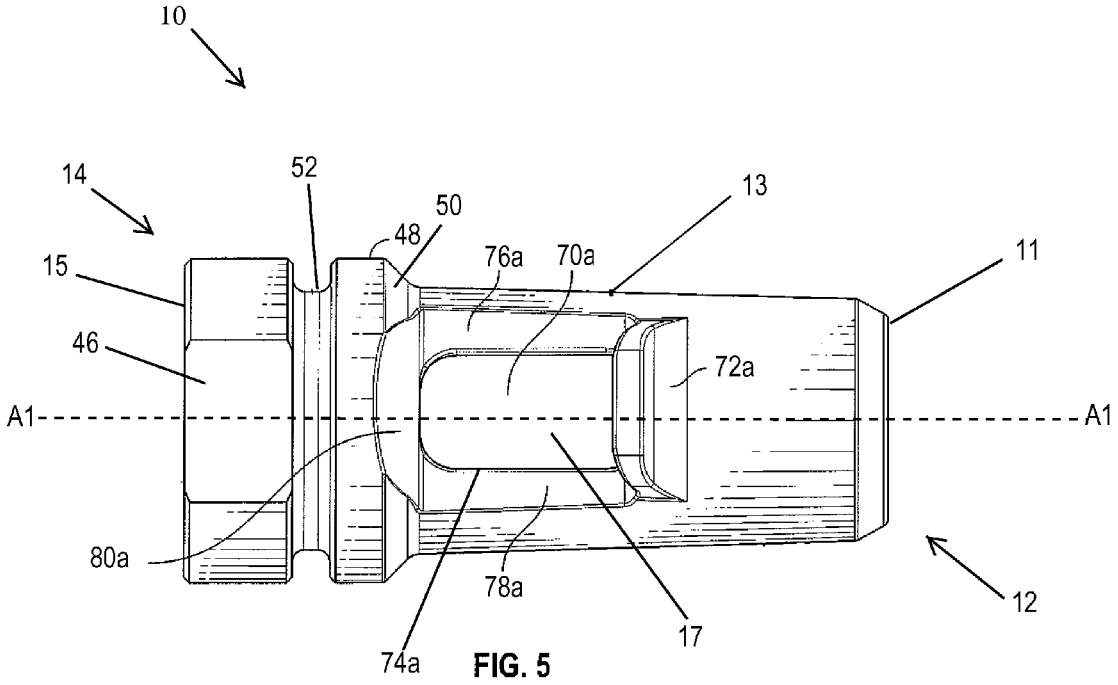
FIG. 5 is a right side view of the muzzle brake of FIG. 2.
Figure 6:
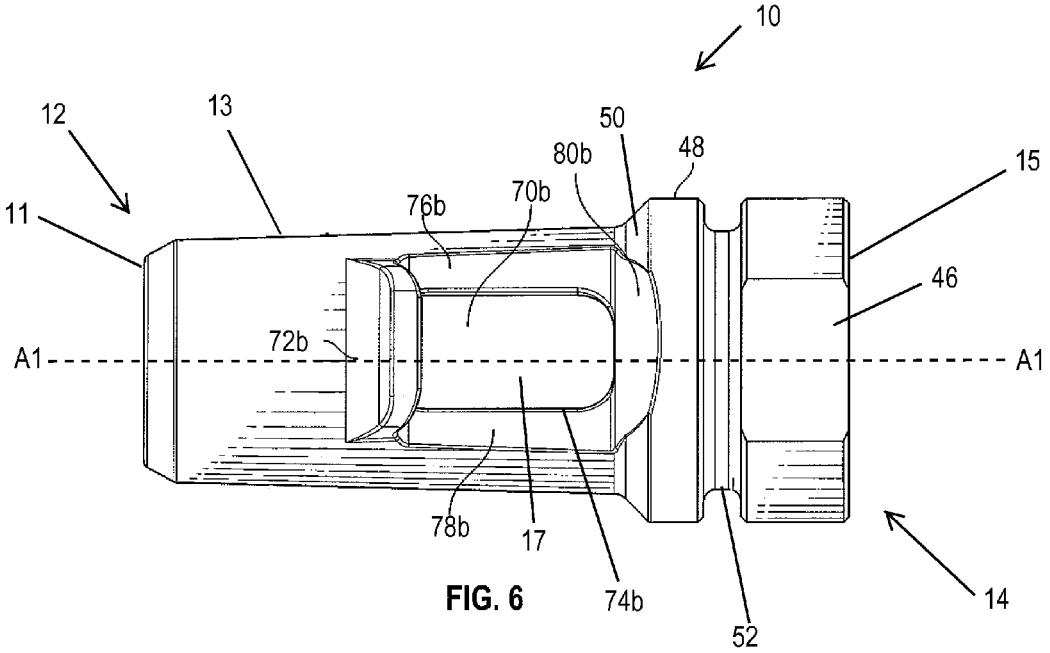
FIG. 6 is a left side view of the muzzle brake of FIG. 2.

FIGS. 5-6 illustrate side views of the example muzzle brake 10 shown in FIG. 2. FIG. 5 is a right side view of the muzzle brake 10. FIG. 6 is a left side view of the muzzle brake 10. As discussed above, the example muzzle brake 10 includes the front end 11, the nose portion 12, the body portion 13, the mounting portion 14, the back end 15, and the internal bore 17. Additionally, in this example the body portion 13 of muzzle brake 10 also includes gas vents 70*a* and 70*b*, projections 72*a* and 72*b*, gas vent frames 74*a* and 74*b*, top frame members 76*a* and 76*b*, bottom frame members 78*a* and 78*b*, and back frame members 80*a* and 80*b*. FIGS. 5-6 also show the flattened sides 46 of mounting portion 14, the annular shoulder 48, chamfer 50, and annular groove 52 discussed above.

Gas vents 70*a* and 70*b* are provided to vent and redirect gas therethrough that is ejected from the muzzle end 9 of a firearm 2. Gas vents 70*a* and 70*b* are approximately rectangles with rounded edges. In alternative embodiments, the gas vents are other shapes, including but not limited to parallelograms, triangles, circles, or ovals.

Projections 72*a* and 72*b* extend from the front sides of gas vents 70*a* and 70*b*, respectively, and are provided to collect gas that passes through gas vents 70*a* and 70*b*, respectively, and to redirect that gas in a preferred direction to reduce recoil of the firearm 2. Projections 72*a* and 72*b* also create turbulence in gas that passes through gas vents 70*a* and 70*b*, respectively. Projections 72*a* and 72*b* are approximately trapezoidal with rounded corners and extend from the body portion 13 of the muzzle brake 10. However, the precise shape and dimensions of the projections can vary. In alternative embodiments, the projections are other shapes, including but not limited to rectangles, squares, semi-circles, as well as irregular shapes and designs. In further alternative embodiments, the projections have flared tips.

Gas vents 70*a* and 70*b* are bounded by gas vent frames 74*a* and 74*b*, respectively. Gas vent frames 74*a* and 74*b* consist of top frame members 76*a* and 76*b*, bottom frame members 78*a* and 78*b*, and back frame members 80*a* and 80*b*.

Top frame members 76*a* and 76*b*, as well as bottom frame members 78*a* and 78*b*, are substantially flat. The pair of top frame member 76*a* and bottom frame member 78*a*, as well as the pair of top frame member 76*b* and bottom frame member 78*b*, each define a distinct plane having a normal line with a component that is sideways and outward from the axis A1 (referred to hereinafter as the longitudinal axis) that goes through the center of the body portion 13 of muzzle brake 10, and a component that is upward and outward from the longitudinal axis A1 of the body portion 13. The sideways, outward components of these planes results from the gas vents' 70*a* and 70*b* positioning on the right and left sides, respectively, of the body portion 13 of muzzle brake 10. The upward, outward components of these planes results from each of the gas vents' 70*a* and 70*b* being positioned with a bias towards the top of the body portion 13 of muzzle brake 10, as discussed in greater detail below.

Back frame member 80*a* is formed on the annular shoulder 48 and is angled outward from the body portion 13 of the muzzle brake 10, and likewise angled relative to the top frame member 76*a* and bottom frame member 78*a*. Likewise, back frame member 80*b* is also formed on the annular shoulder 50 and is angled outward from the body portion 13 of the muzzle brake 10, and likewise angled relative to the top frame member 76*b* and bottom frame member 78*b*. The angles of back frame members 80*a* and 80*b* will be discussed in greater detail below.

As further shown in FIGS. 5-6, the exterior surface of body portion 13 of example muzzle brake 10 tapers towards nose portion 12. The tapering of the outer surface of body portion 13 facilitates the casting process (as described below), and can also reduce the amount of material required to manufacture, and therefore the weight and cost of, the muzzle brake 10. In an alternative embodiment, the body portion of the muzzle brake is substantially cylindrical and not tapered.

Figure 7:
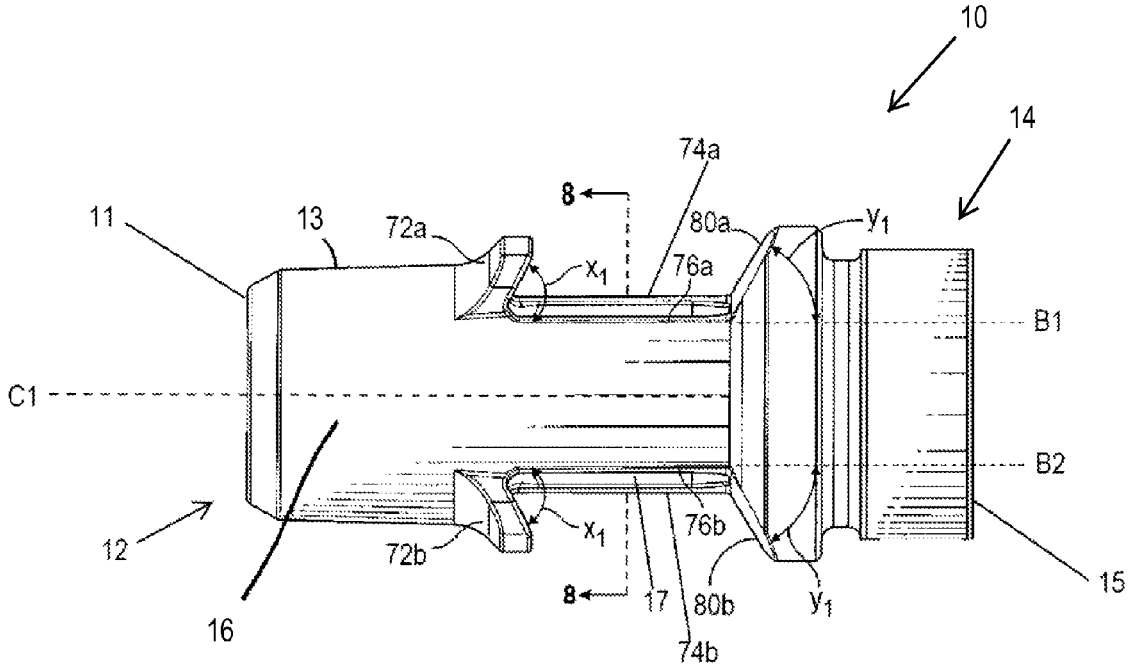
FIG. 7 is a top view of the muzzle brake of FIG. 2.

FIG. 7 is a top view of the example muzzle brake of FIG. 2. As discussed above, the example muzzle brake 10 includes the front end 11, the nose portion 12, the body portion 13, the mounting portion 14, the back end 15, and the internal bore 17. In this example, the body portion 13 of the muzzle brake 10 also has a top surface 16 as described above. FIG. 7 also shows the projections 72*a* and 72*b*, gas vent frames 74*a* and 74*b*, top frame members 76*a* and 76*b*, and back frame members 80*a* and 80*b* as discussed above.

As shown in FIG. 7, muzzle brake 10 has an angle $x_1$ between a rearward facing gas capturing surface of the projection 72*a* and top frame member 76*a*, and an equivalent angle $x_1$ between a rearward facing gas capturing surface of the projection 72*b* and the top frame member 76*b*. There is also an angle $y_1$ between back frame member 80*a* and an imaginary line B1 extending from top frame member 76*a*, and an equivalent angle $y_1$ between back frame member 80*b* and an imaginary line B2 extending from top frame member 76*b*. In this exemplary embodiment, $x_1=y_1$.

The angled orientation of the projections 72*a* and 72*b* relative to the body portion 13 of the muzzle brake 10 helps to create the desired turbulence and redirection of expanding gases generated during firing of a firearm to reduce or neutralize recoil.

When the muzzle brake 10 is fully mounted on the firearm 2, the apex of the muzzle brake, as defined by an imaginary line C1 on the top surface 16 of the muzzle brake body portion 13 of the muzzle brake 10 that bisects the top surface 16 between the projections 72*a* and 72*b*, is at the 12 o'clock position as measured when the firearm is being held in a conventional firing position. To facilitate this desirable mounted configuration, the mounting portion 14 of the muzzle brake 10 is configured to screw onto the muzzle end of the barrel such that the screw threads stop advancing onto the muzzle end of the barrel when the aforementioned apex of the muzzle brake reaches the 12 o'clock position. Mounting the muzzle brake with its apex at the 12 o'clock position optimizes the direction of the deflection of exploding gases by projections 72*a* and 72*b* and optimizes the angle of capture and redirection of gas flow through muzzle brake's gas vents to reduce or eliminate both axial recoil and upward kick of the firearm resulting from firing.

In an alternative embodiment, washers or other annular discs (through which a projectile can travel without impediment) can be inserted into the threaded cavity in the mounting portion 14 of the muzzle brake 10 to decrease the depth of the cavity such that the apex of the muzzle brake aligns with the 12 o'clock position when the threads are fully screwed onto the muzzle end of the barrel and stop rotating. In one non-limiting example, a desired number of suitable washers having a thickness of $1/2000^{th}$ of an inch or less can be arranged together and used for this purpose to ensure a high degree of precision with respect to achieving a 12 o'clock position for the apex of the muzzle brake when the firearm is held in the conventional firing position.

Figure 8:
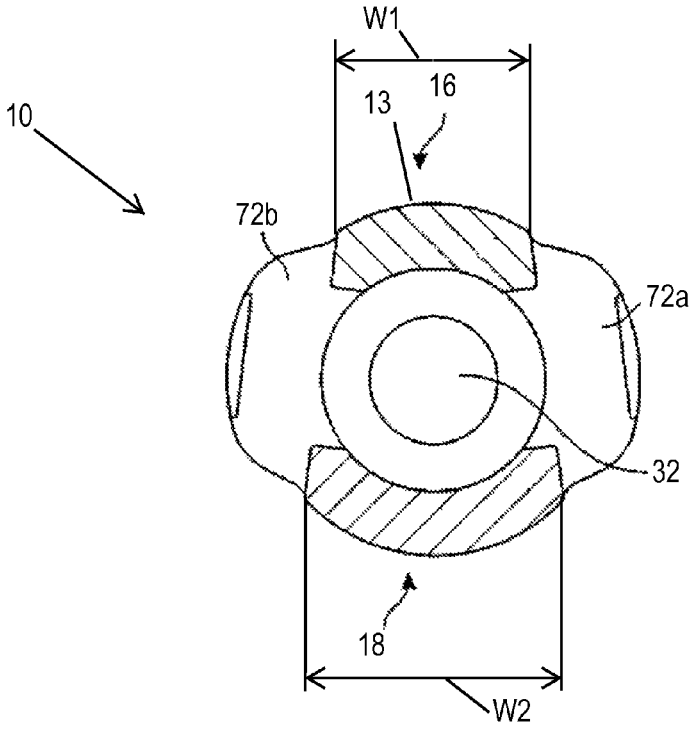
FIG. 8 is a cross-sectional view of the muzzle brake of FIG. 2 along line 8-8 in FIG. 7.

FIG. 8 is a cross-sectional view of the example muzzle brake 10 of FIG. 2 along line 8-8 in FIG. 7. As discussed above, the example muzzle brake 10 includes a body portion 13. Body portion 13 has top surface 16, bottom surface 18, and projections 72*a* and 72*b* extending therefrom. FIG. 8 also shows the opening 32 discussed above.

As shown in FIG. 8, top surface 16 of the body portion 13 of muzzle brake 10 has a width W1 that is narrower than a width W2 of bottom surface 18. This is due to the positioning bias of the projections 72*a* and 72*b*, and corresponding gas vents situated directly behind the projections, towards top surface 16 and away from bottom surface 18. The bias of the gas vents, and of the projections 72*a* and 72*b*, towards the top surface 16 of the muzzle brake (as discussed in greater detail below), provides an upward component to the velocity of expelled gases through the gas vents, thereby reducing or neutralizing upward kick/recoil of the firearm.

Figure 9:
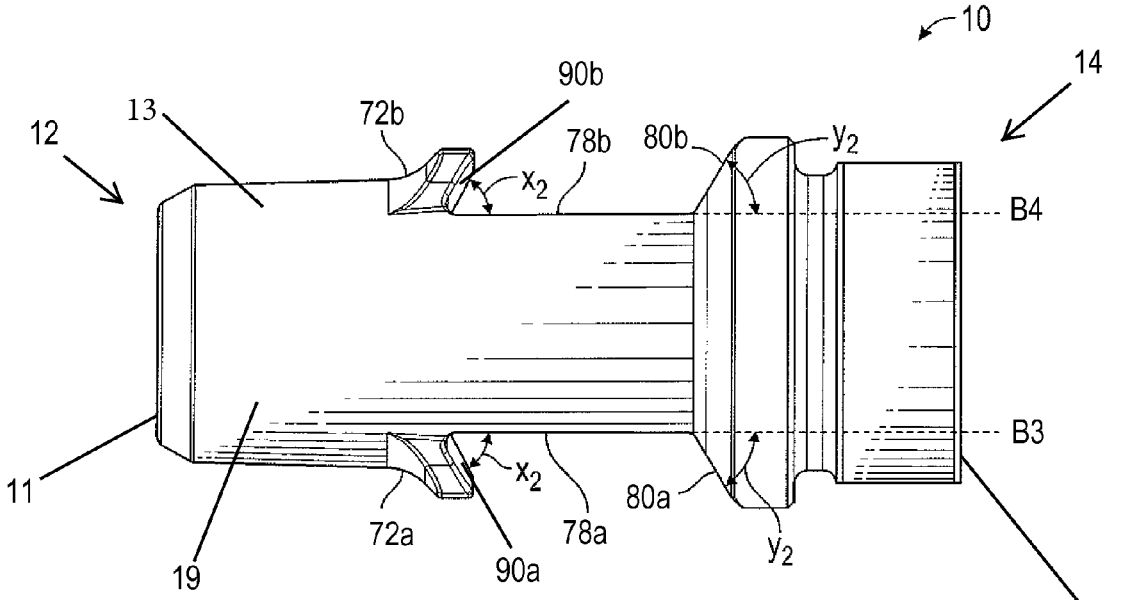
FIG. 9 is a bottom view of the muzzle brake of FIG. 2.

FIG. 9 is a bottom view of the example muzzle brake of FIG. 2. As discussed above, the example muzzle brake 10 includes the front end 11, the nose portion 12, the body portion 13, the mounting portion 14, and the back end 15. FIG. 9 also shows the exterior surface 19 of the body portion 13, the projections 72*a* and 72*b*, bottom frame members 78*a* and 78*b*, and back frame members 80*a* and 80*b*, as discussed above. Additionally, in this example the projections 72*a* and 72*b* extending from the body portion 13 of the muzzle brake 10 have gas capturing surfaces 90*a* and 90*b*, respectively.

Gas capturing surfaces 90*a* and 90*b* capture expanding gas generated from firing a firearm, and/or create turbulence in those gases to reduce or neutralize recoil of the firearm. Gas capturing surfaces 90*a* and 90*b* also redirect expanding gases both upwards, and backwards towards the shooter to reduce or neutralize recoil of the firearm when the apex of muzzle brake is mounted and aligned with the 12 o'clock position as described above.

As further shown in FIG. 9, muzzle brake 10 has an angle $x_2$ between the gas capturing surface 90*a* of projection 72*a* and bottom frame member 78*a*, and an equivalent angle $x_2$ between the gas capturing surface 90*b* of projection 72*b* and bottom frame member 78*b*. There is also an angle $y_2$ between back frame member 80*a* and an imaginary line B3 extending from back frame member 80*a*, and an equivalent angle $y_2$ back frame member 80*b* and an imaginary line B4 extending from back frame member 80*b*.

As further shown in FIG. 9, the wings 72*a* and 72*b* extend beyond the profile of body portion 13 of the muzzle brake 10. Thus, the gas capturing surfaces 90*a* and 90*b* of projections 72*a* and 72*b*, respectively, are external to the exterior surface 19 of the body portion 13 of the muzzle brake. This allows for provision of a narrower body portion 13 of the muzzle brake than would be required were the gas capturing surfaces interior to the wall (i.e. within the profile) of body portion 13. The external nature of projections 72*a* and 72*b* reduces the weight of the muzzle brake 10, and accordingly reduces the cost of manufacturing it.

Moreover, were the gas capturing surfaces built into (i.e. internal to) the walls of the body portion, the walls of the body portion necessarily would be thicker to accommodate the angled gas capturing surfaces. The body portion of the muzzle brake, and therefore the muzzle brake as a whole, would thereby have to be wider in diameter to accommodate this extra wall thickness without reducing the diameter of the body portion's hollow internal bore through which the projectile travels, thereby increasing the weight of the muzzle brake and the amount of material needed to manufacture it.

Referring to both FIGS. 7 and 9, in the example muzzle brake 10, $x_1=x_2=y_1=y_2$, and each is about 60°. In alternative embodiments, each of $x_1$, $y_1$, $x_2$, and $y_2$ have a value from about 45° to about 70°. Other possible embodiments have other angles $x_1$, $y_1$, $x_2$, and $y_2$ outside of these ranges. According to some examples of these further embodiments $x_1=x_2=y_1=y_2$. According to other examples of these further embodiments, $x_1>y_1$ and $x_2>y_2$. As discussed below with reference to FIG. 15, these angle magnitude relationships result from an example manufacturing process of muzzle brakes in accordance with the present disclosure. However, other angles and/or relationships between the various angles can be provided in other embodiments.

Figure 10:
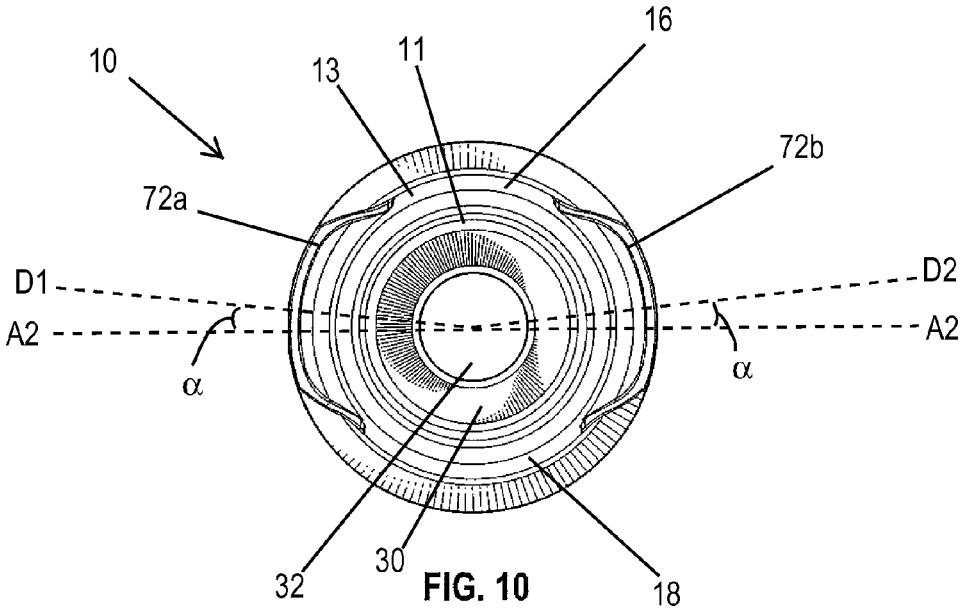
FIG. 10 is a front view of the muzzle brake of FIG. 2.

FIG. 10 is a front view of the muzzle brake of FIG. 2. As discussed above, the example muzzle brake 10 includes the body portion 13, having a top surface 16 and bottom surface 18. FIG. 10 also shows the annular depressed region 30 and the opening 32 at the nose of the muzzle brake 10, as well as the projections 72*a* and 72*b* extending from the body portion 13 as discussed above.

As further shown in FIG. 10, projections 72*a* and 72*b* of muzzle brake 10 are biased towards the top surface 16 of the body portion 13 by an angle α. Angle α is the angle measured between a horizontal axis of the muzzle brake A2, and central radial axes D1 and D2 originating in the center of the muzzle brake 10 and bisecting the projections 72*a* and 72*b*, respectively. In the example shown in the figure, α is about 7°. In alternative embodiments of a muzzle brake in accordance with the present disclosure, a is in a range from about 0° to about 20°. In some examples, α is in a range from about 4° to about 10°. In further alternative embodiments, the angle between axes A2 and D1 need not be identical to the angle between axes A2 and D2.

Figure 11:
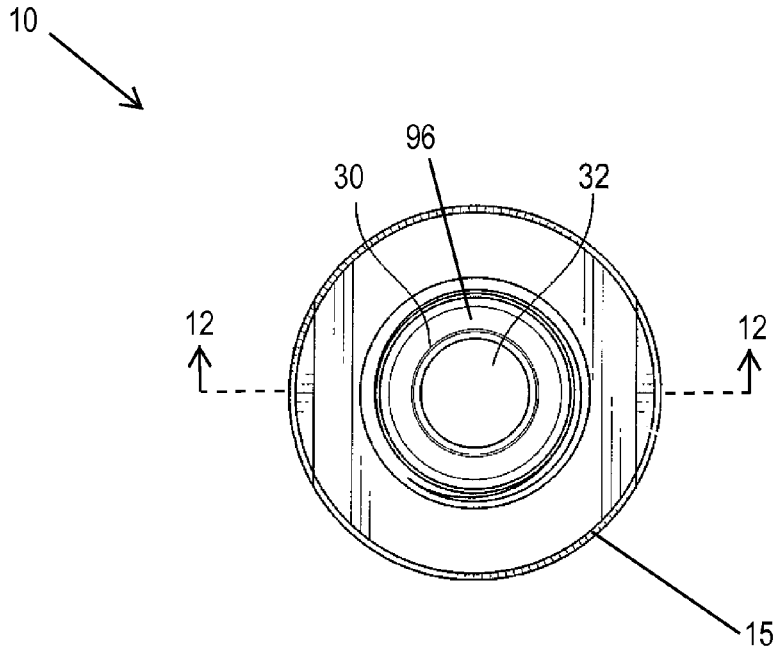
FIG. 11 is a back view of the muzzle brake of FIG. 2.

FIG. 11 is a back view of the muzzle brake of FIG. 2. As discussed above, the example muzzle brake 10 includes a back end 15, and an annular depressed region 30 and opening 32 in the nose of the muzzle brake 10. FIG. 11 also shows the rear interior surface 96 of annular depressed region 30.

Figure 12:
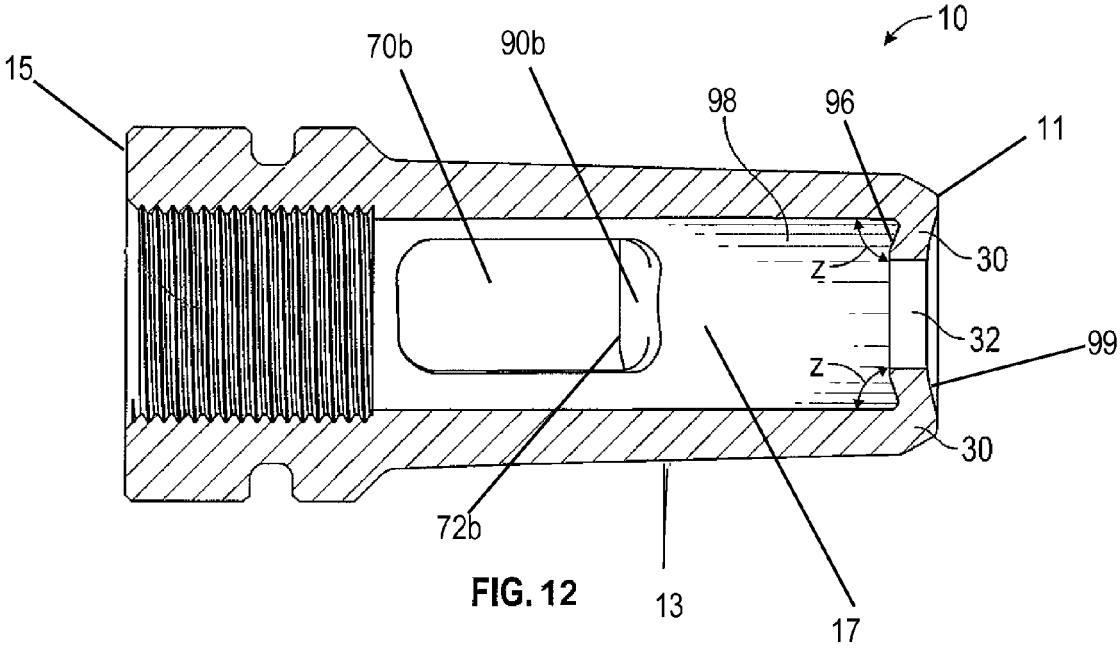
FIG. 12 is a cross-sectional view of the muzzle brake of FIG. 2 along line 12-12 in FIG. 11.

FIG. 12 is a cross-sectional view of the muzzle brake of FIG. 2 along line 12-12 in FIG. 11. As discussed above, the example muzzle brake 10 includes a front end 11, body portion 13, back end 15, and internal bore 17. FIG. 12 also shows annular depressed region 30, opening 32, gas vent 70*b*, projection 72*b* with its gas capturing surface 90*b*, and rear interior surface 96 of the annular depressed region 30 as discussed above. FIG. 12 also shows an interior surface 98 of the body portion 13 of the muzzle brake 10 and an exterior, front surface 99 of annular depressed region 30.

As shown in FIG. 12, at the juncture of the rear interior surface 96 of the annular depressed region 30 and the interior surface 98 of the body portion 13 of the muzzle brake 10, there is an angle z therebetween. In the example embodiment shown in FIG. 12, angle z is about 75°. In some embodiments the angle z is in a range from about 70° to about 80°. Other possible embodiments have an angle z outside of these ranges.

The rear interior surface 96 of annular depressed region 30 creates turbulence in the propellant gases generated by firing the firearm as those gases move along the internal bore 17 of body portion 13 and seek to escape through opening 32 through which the projectile exits, thereby reducing or neutralizing recoil.

As further shown in FIG. 12, both the rear interior surface 96 and exterior, front surface 99 of the annular depressed region 30 are depressed, providing a generally concave profile to the exterior, front surface 99 of annular depressed region 30, and a generally convex profile to the rear interior surface 96 of annular depressed region 30. The concavity of the exterior, front surface 99 of annular depressed region 30 helps to avoid sharp angles or edges around opening 32. As discussed above, the convexity of the rear interior surface 96 of annular depressed region 30 captures exploding, propellant gases that would otherwise exit the front of the muzzle through opening 32, and creates turbulence in those gases, thereby reducing recoil/kick of the firearm. In some embodiments of the present disclosure the shape of the concavity of the exterior, front surface 99 is bowl-shaped. Similarly, in some embodiments, the convexity of rear interior surface 96 is bowl-shaped. In other embodiments the shape of the concavity of the exterior, front surface of the annular depressed region and/or the shape of the convexity of the interior, rear surface of the annular depressed region is/are approximately conical or frusto-conical.

Figure 13:
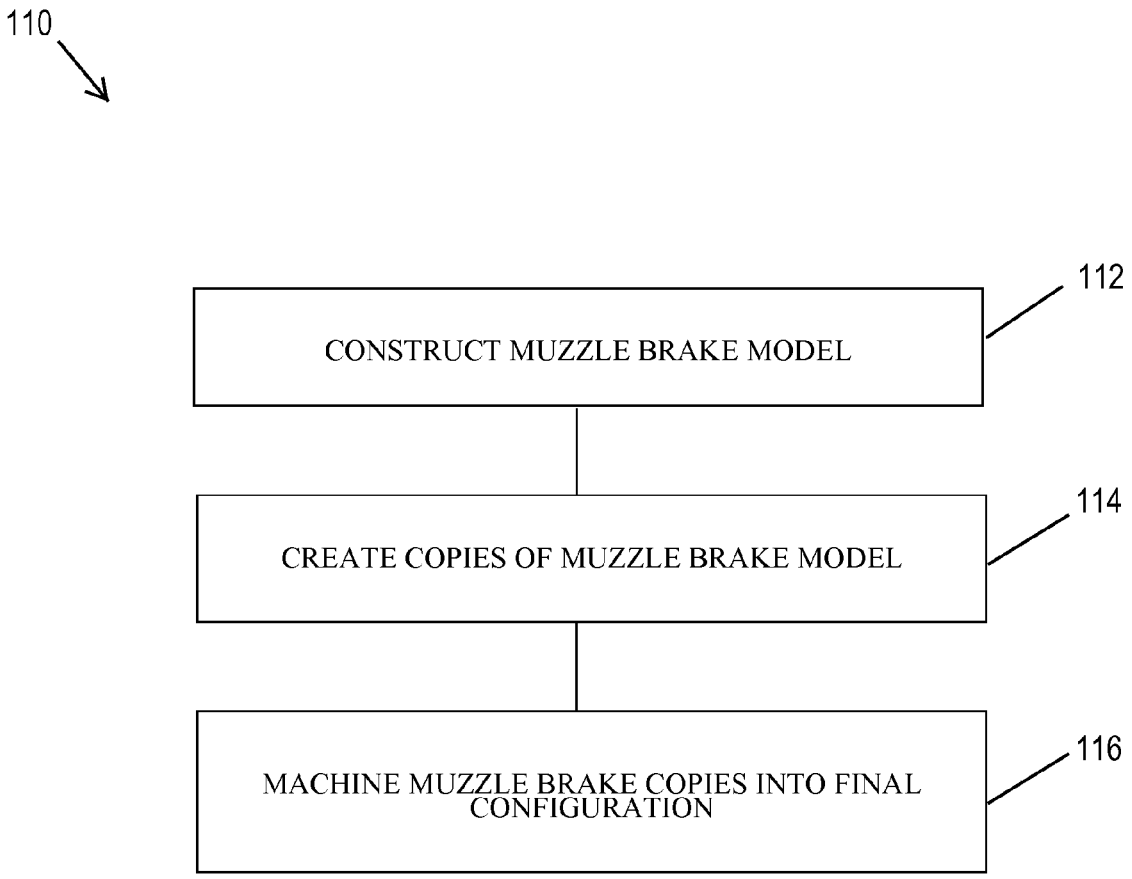
FIG. 13 illustrates an example method of manufacturing muzzle brakes in accordance with the present disclosure.

FIG. 13 illustrates an example method 110 of manufacturing muzzle brakes in accordance with the present disclosure. In this example, the method 110 includes operations 112, 114, and 116.

In accordance with this example method 110, in an operation 112 a model muzzle brake is constructed, in an operation 114 copies are made of the model muzzle brake model, and in operation 116 the muzzle brake copies are machined into their final configuration for mounting on, and use with, a firearm.

Figure 14:
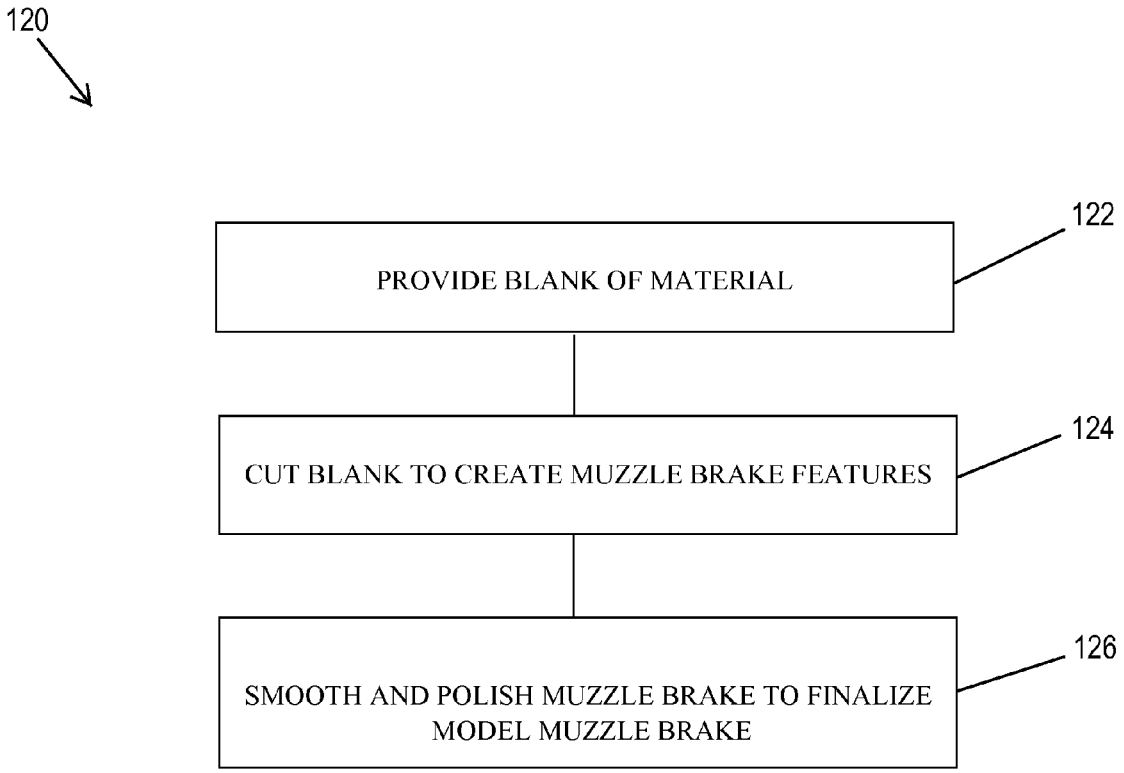
FIG. 14 illustrates an example method of manufacturing a muzzle brake model.

FIG. 14 illustrates an example method 120 of manufacturing a muzzle brake model, showing example steps that can be taken to complete operation 112 of FIG. 13. In this example the method 120 includes operations 122, 124, and 126.

In accordance with this example method 120 in an operation 122 a blank of material is provided that is sufficiently sized from which to cut a muzzle brake in accordance with the present disclosure. In an operation 124, the blank of material is cut to create the features of the muzzle brake. In an operation 126 the surface and edges of the muzzle brake's features are smoothed and polished to complete the muzzle brake model.

In some embodiments of example method 120, operation 124 is performed by a tool used to cut and shape material, such as a die. In some embodiments of example method 120, operation 126 is performed with a sanding device, a shaving device, or both.

It should be noted that muzzle brakes in accordance with this present disclosure can be manufactured through example method 120 alone, without requiring operations associated with methods 130 and 170 described below.

Figure 15:
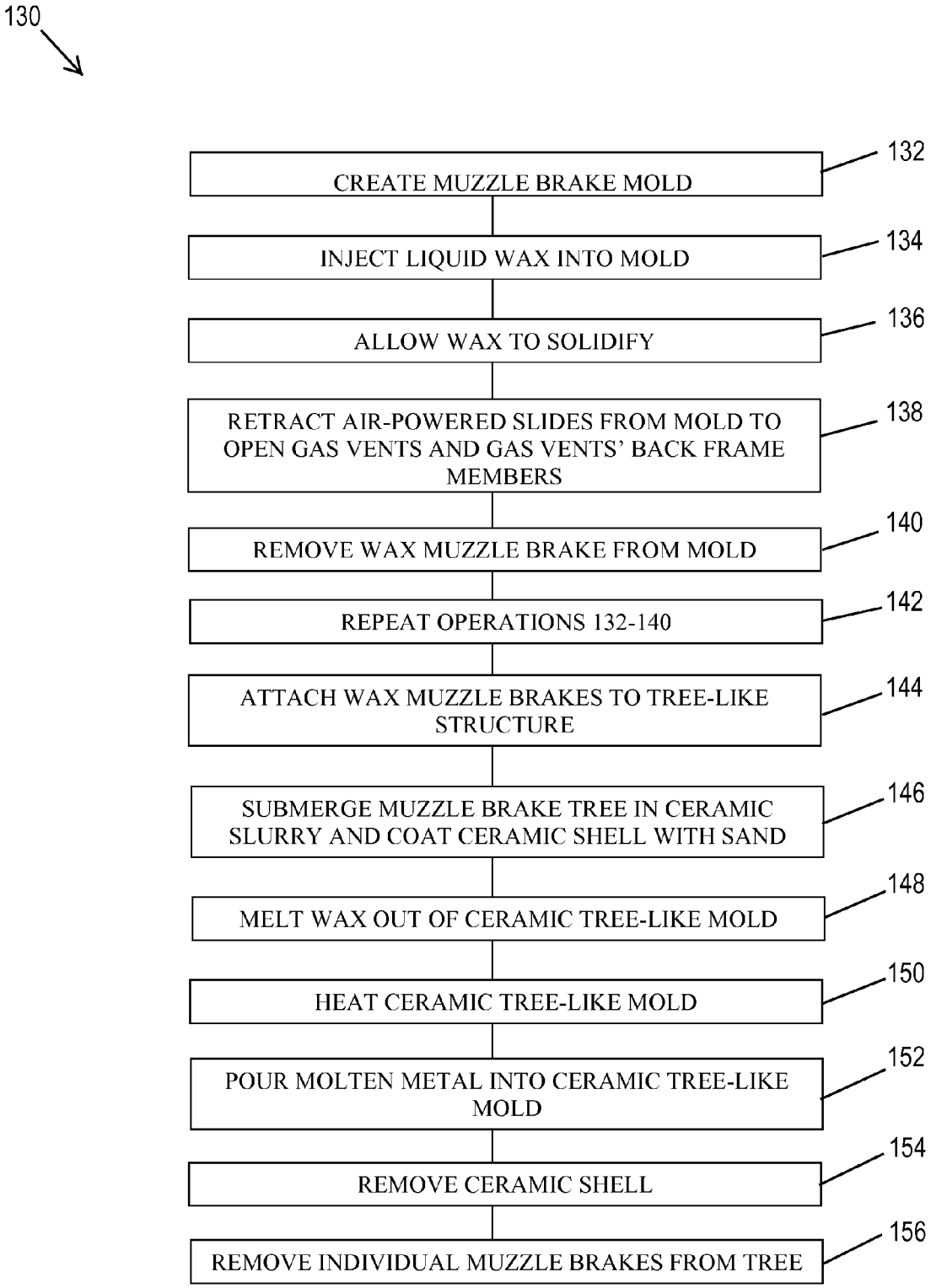
FIG. 15 illustrates an example investment casting method for making copies of a muzzle brake model.

FIG. 15 illustrates an example method 130 of investment casting to make copies of a muzzle brake model. The method 130 is one example of the operation 114 shown in FIG. 13. In this example, the method 130 includes operations 132, 134, 136, 138, 140, 142, 144, 146, 148, 150, 152, 154, and 156.

In accordance with this example method 130, in an operation 132, a muzzle brake mold is created using a model muzzle brake such as that made by method 120 discussed above in connection with FIG. 14. In one example embodiment of this method, the mold is made from aluminum. In an operation 134, liquid wax is injected into the mold in accordance with known methods to create a wax muzzle brake that is a replica of the model muzzle brake used to create the mold. In an operation 136, the wax is allowed to solidify in the mold. In an operation 138 air-powered slides on either side of the mold are retracted from the mold at an angle toward the back end of the wax muzzle brake, opening up gas vents 70*a* and 70*b* and resulting in back frame members 80*a* and 80*b* behind the gas vents 70*a* and 70*b*, respectively (see FIGS. 5-6).

The air-powered slides are retracted from the mold in this direction (as opposed to straight outward or towards the nose of the muzzle brake) so as not to disturb or interfere with projections 72*a* and 72*b*, and to maintain the angles $x_1$ and $x_2$ of the projections (see FIGS. 7 and 9). Therefore, to facilitate the retraction of the air-powered slides from the mold and to maintain the desired angles of the projections 72*a* and 72*b* off the body of the muzzle brake, angle $y_1 \leq$angle $x_1$ (see FIG. 7); and angle $y_2 \leq$angle $x_2$ (see FIG. 9).

In an operation 140 the hardened wax muzzle brake is removed from the mold. In an operation 142, operations 132 through 140 are repeated one or more times to create multiple wax muzzle brakes. With respect to the wax muzzle brake's features and dimensions, the wax muzzle brakes differ from the final product only in that they do not contain screw threads in the mounting portion or an opening at the nose through which the projectile exits the muzzle brake, which can formed in a separate process at the end of the example manufacturing method 130. In an alternative manufacturing process, the opening in the nose through which the projectile exits the muzzle brake is molded as a feature of the wax muzzle brake(s). It should be noted that the method 130 can be completed to create a single muzzle brake copy by optionally omitting operation 142.

In an operation 144, multiple wax muzzle brakes are attached to a wax tree-like structure. The tree-like structure may have one or multiple branches to which one or more wax muzzle brakes are attached. The muzzle brakes are attached via any suitable means (e.g., by melting) from their back ends to the tree-like structure. The tree-like structure is designed according to known investment molding methods such that when the wax is melted away from the subsequently formed ceramic molds as described below, a complex of channels is opened permitting access to each ceramic muzzle brake mold from a common entrance point through which molten metal is poured.

In an operation 146, a ceramic mold of the muzzle brake tree structure is made. To create the ceramic molds, the wax tree-like structure with attached wax muzzle brakes is prepared for and dipped in a ceramic slurry in accordance with known methods. Once the ceramic hardens and dries on the wax, it is treated with sand, and the process can be repeated multiple times, adding layers of ceramic and sand until the desired thickness and strength of ceramic is achieved.

In an operation 148, the wax is melted out of the ceramic mold of the muzzle brake tree-like structure through an entrance/exit point prepared for this purpose in accordance with known methods, leaving a ceramic mold of a tree-like structure of muzzle brakes.

In an operation 150, the ceramic tree-like structure is heated.

In an operation 152, a molten metal alloy is poured through the entrance point of the ceramic tree-like structure into the hollowed out ceramic muzzle brake molds, and allowed to cool and harden. In one exemplary embodiment, the alloy used is 17-4 PH stainless steel, though it will be understood that a variety of metals and/or metal alloys would be suitable for the muzzle brake of the present disclosure.

In some embodiments of example manufacturing method 130, the model muzzle brake, molds, and muzzle brake copies are designed such that the exterior surface of the body portion of each muzzle brake is tapered towards the nose. This facilitates the advancement of the molten metal into the individual ceramic muzzle brake molds during the casting operation 152, resulting in a more refined and consistent final product with fewer irregularities. A tapered muzzle brake also requires less material to manufacture and weighs less than a non-tapered or more cylindrical muzzle brake.

In an operation 154, the ceramic shell is removed from the metal cast muzzle brakes through known means, such as vibration treatment.

In an operation 156, the individual metal muzzle brake copies are then removed from the muzzle brake tree structure in accordance with known methods, and sanded and/or polished as necessary to remove imperfections.

Figure 16:
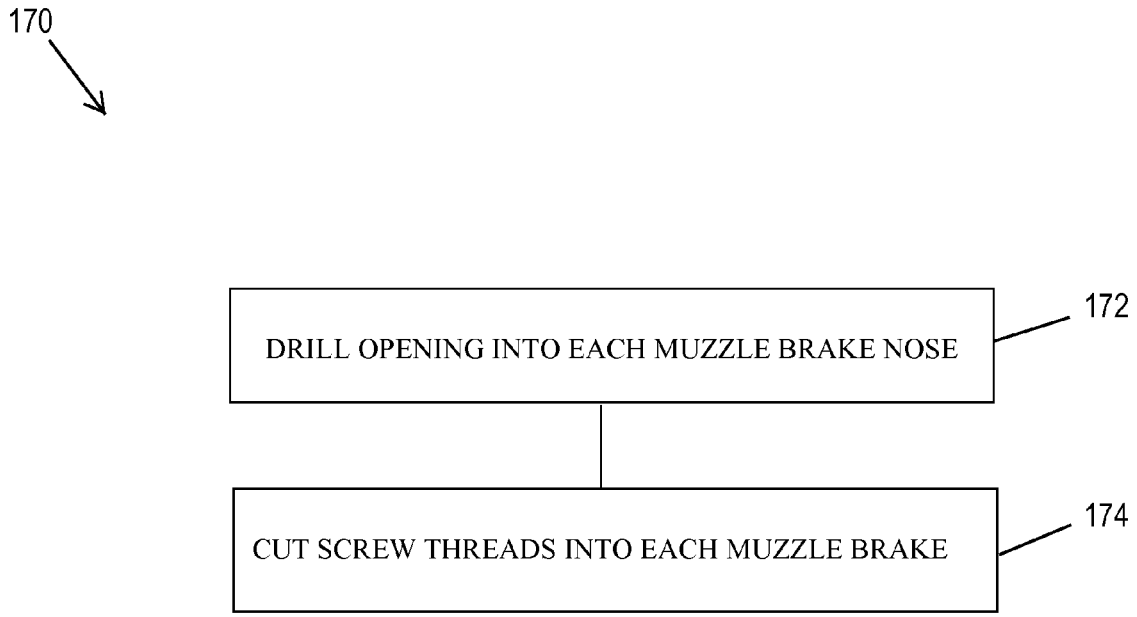
FIG. 16 illustrates an example method of machining muzzle brake model copies into their final configuration for mounting on, and use with, a firearm.

FIG. 16 illustrates an example method 170 of machining one or more muzzle brake model copies into their final configuration for mounting on, and use with, a firearm. The method 170 is an example of operation 116 shown in FIG. 13. In this example, method 170 includes operations 172 and 174.

In the operation 172, the opening through which the projectile exits the muzzle brake is drilled in the nose of each muzzle brake copy. In an alternative manufacturing process, operation 172 is omitted, as the opening in the nose through which the projectile exits the muzzle brake is cast as a feature of the muzzle brake(s) earlier in the manufacturing process. In an operation 174, screw threads are cut into the mounting portion of each muzzle brake to complete the manufacturing process.

In one embodiment, operations 172 and 174 create an opening and screw threads, respectively, that are configured for the barrel and ammunition of a 556 caliber rifle. It should be noted, however, that muzzle brakes in accordance with the present disclosure can be configured to operate with a variety of firearms and calibers without departing from the disclosures herein.

Figure 17:
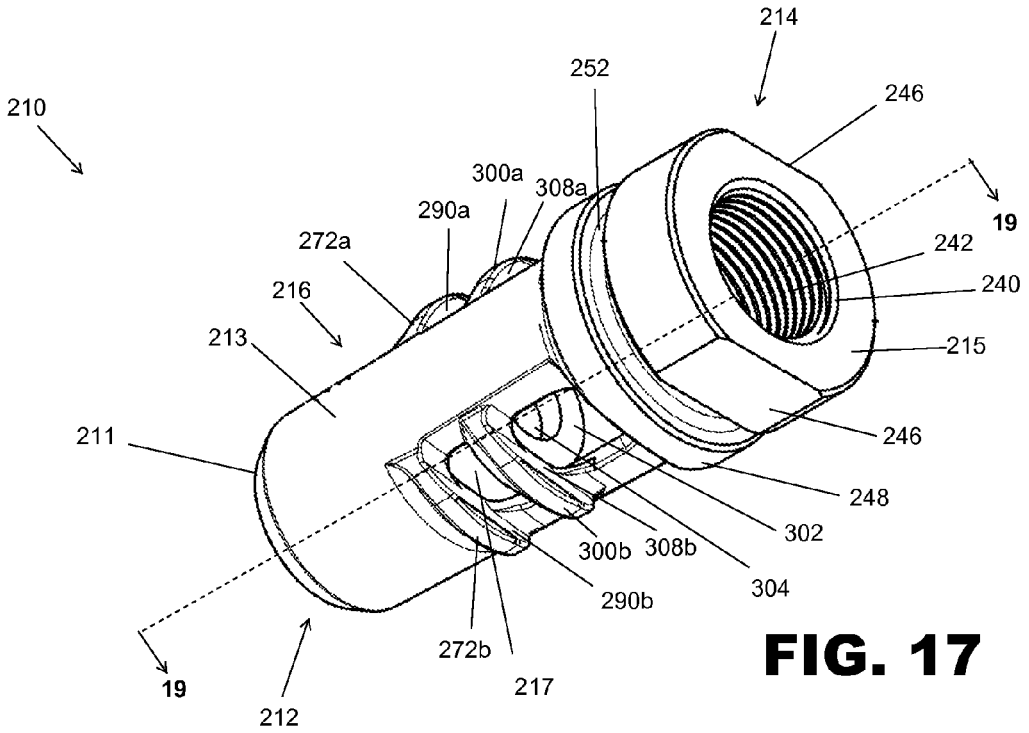
FIG. 17 is a top, rear, left side perspective view of an alternative embodiment of a muzzle brake in accordance with the present disclosure.

FIG. 17 is a top, rear, left side perspective view of an alternative embodiment of a muzzle brake in accordance with the present disclosure. In this example, the muzzle brake 210 includes a front end 211, a nose portion 212, a body portion 213, a mounting portion 214, a back end 215, a top 216 and an internal bore 217. The mounting portion 214 includes a muzzle engagement part 240, opening 242, screw threads 244, flattened sides 246, annular shoulder 248, and annular groove 252.

The body portion 213 of example muzzle brake 210 also includes a first pair of projections 272*a* and 272*b* having gas capturing surfaces 290*a* and 290*b*, respectively, a second pair of projections 300*a* and 300*b*, and an annular wall 302. The annular wall 302 includes opening 304 and rear-facing surface 306. The second pair of projections 300*a* and 300*b* include gas capturing surfaces 308*a* and 308*b*, respectively.

In this example muzzle brake 210 the front end 211 is opposite the back end 215. Top 16 faces upwards when the muzzle brake 210 is properly mounted to a firearm that is being held in a conventional firing position.

Muzzle engagement part 240 engages the muzzle end of the barrel of a firearm to secure the example muzzle brake 210 to the firearm. To secure the muzzle brake 210 to the firearm, opening 242 is placed over the muzzle end of the firearm barrel. Screw threads 244 are internal to the muzzle engagement part 240 and mate with corresponding screw threads on the muzzle end of the firearm barrel.

Opening 242 is in open communication with, and extends without interruption through mounting portion 214 and through to the internal bore 217 of body portion 213.

Flattened sides 246 of muzzle engagement part 240 facilitate mounting of the muzzle brake 210 to the muzzle end of the firearm barrel. The muzzle brake can be mounted on the muzzle end of a firearm with any suitable tool, for example with a wrench. By way of example, a wrench can grasp the flattened sides 246 of muzzle engagement part 240 to facilitate mounting of the muzzle brake on the muzzle end of the firearm barrel. In some embodiments, the muzzle engagement part of the muzzle brake may have more or fewer flattened sides.

Annular shoulder 248 is at the forward end of mounting portion 214.

Annular groove 252 in the example muzzle brake 210 is situated between muzzle engagement part 240 and annular shoulder 248 and corresponds to a reduction in the amount of metal necessary to manufacture muzzle brake 210, thereby additionally reducing the weight of the muzzle brake Annular groove 252 also facilitates grasping the muzzle engagement part 240 of the muzzle brake 210 with suitable mounting tools.

In alternative examples of a muzzle brake in accordance with the present disclosure, the muzzle brake is mounted by alternative means (e.g. without screw threads), as will be apparent to those having skill in the art.

Projections 272*a* and 272*b*, and 300*a* and 300*b*, extend from the body portion 213 and are provided to collect gas that passes through internal bore 217 when firing a firearm, and to redirect that gas in a preferred direction to reduce recoil of the firearm. Projections 272*a*, 272*b*, 300*a*, and 300*b* also create turbulence in propellant gas generated when firing a firearm. Projections 272*a*, 272*b*, 300*a* and 300*b* are approximately trapezoidal with rounded corners and extend from the body portion 213 of the muzzle brake 210. However, the precise shape and dimensions of each of the projections can vary. In alternative embodiments, one or more of the projections are other shapes, including but not limited to rectangles, squares, semi-circles, as well as irregular shapes and designs. In further alternative embodiments, one or more of the projections have flared tips.

Projections 272*a*, 272*b*, 300*a*, and 300*b* extend from locations on the body portion 213 of muzzle brake 210 that are biased towards the top surface 216 of the body portion 213. This top-biasing counteracts upward kick or recoil of a firearm as discussed above.

Annular wall 302 is disposed within internal bore 217 of body portion 213 and between projections 300*a* and 300*b*. Opening 304 in annular wall 302 permits passage of a projectile therethrough. Rear-facing surface 306 of annular wall 302 captures propellant gases travelling through internal bore 217 generated while firing a the firearm and helps redirect such gas towards projections 300*a* and 300*b*.

Figure 18:
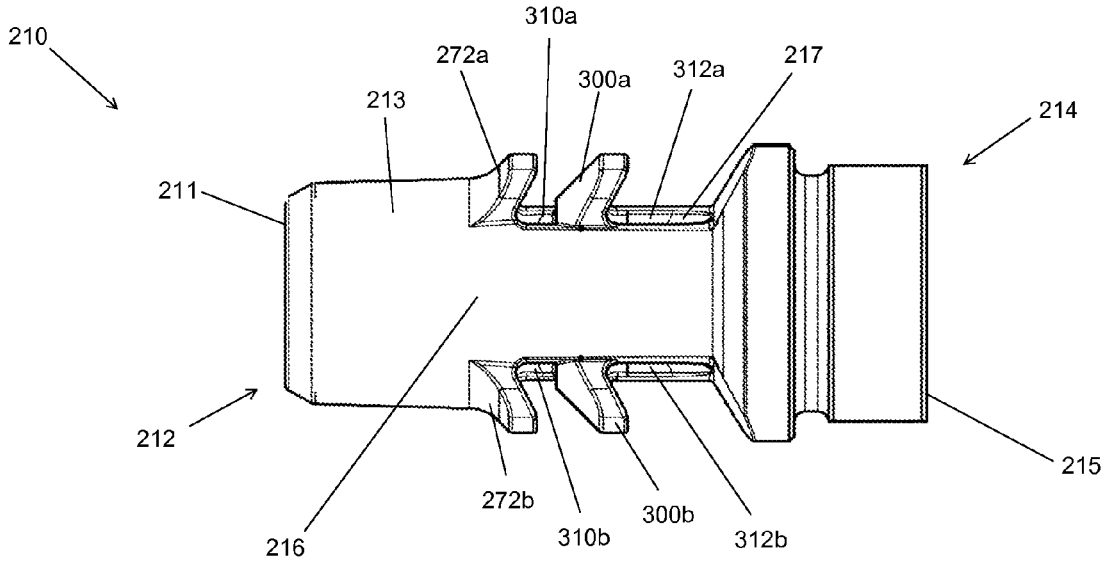
FIG. 18 is a top view of the muzzle brake of FIG. 17.
Figure 19:
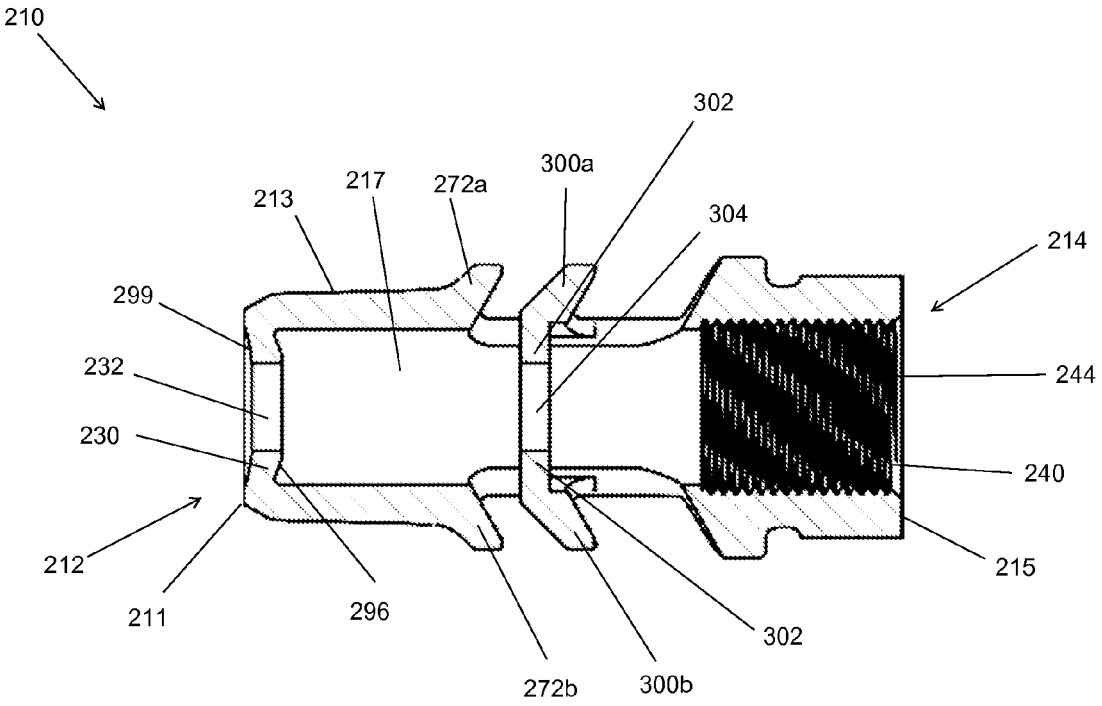
FIG. 19 is a cross-sectional view of the muzzle brake of FIG. 17 along line 19-19 in FIG. 17.

Gas capturing surfaces 290*a*, 290*b*, 308*a*, and 308*b* are angled both upwards toward top 216 of muzzle brake 210 to redirect propellant gases upward, and rearwards toward back end 215 of muzzle brake 210 to redirect propellant gases rearward. In addition to extending from body portion 213, projections 300*a* and 300*b* extend from opposing edges of annular wall 302 as shown in FIG. 19. FIG. 18 is a top view of the muzzle brake of FIG. 17. The example muzzle brake 210 of FIG. 18 includes front end 211, nose portion 212, body portion 213, mounting portion 214, back end 215, top 216, internal bore 217, a first pair of projections 272*a* and 272*b*, and a second pair of projections 300*a* and 300*b* as discussed above. In this example, the muzzle brake 210 also includes a first pair of gas vents 310*a* and 310*b*, and a second pair of gas vents 312*a* and 312*b*.

Gas vents 310*a*, 310*b*, 312*a*, and 312*b* are in open communication with internal bore 217 of body portion 213 of example muzzle brake 210. Each pair of gas vents—310*a* and 310*b*, and 312*a* and 312*b*, respectively, is symmetrically biased towards the top 216 of muzzle brake 210. Propellant gas generated during firing of a firearm is redirected through gas vents 310*a*, 310*b*, 312*a*, and 312*b*, thereby counteracting barrel axial recoil of the firearm in the manner described above. In addition, the bias of the gas vents 310*a*, 310*b*, 312*a*, and 312*b* towards the top 216 of the muzzle brake 210 counteracts upward recoil of the firearm in the manner described above.

FIG. 19 is a cross-sectional view of the muzzle brake of FIG. 17 along line 19-19 in FIG. 17. The example muzzle brake 210 of FIG. 19 includes front end 211, nose portion 212, body portion 213, mounting portion 214, back end 215, internal bore 217, muzzle engagement part 240, screw threads 244, a first pair of projections 272*a* and 272*b*, a second pair of projections 300*a* and 300*b*, and annular wall 302 with opening 304 therein as discussed above. In this example, the nose portion 212 of muzzle brake 210 also includes a depressed region 230 and opening 232 through which a projectile exits the muzzle brake, the depressed region 230 including an interior, rear surface 296 and an exterior, front surface 299.

In a typical firing of the firearm, the projectile exits the barrel of the firearm and enters the example muzzle brake 210 through its back end 215. The projectile then passes through mounting portion 214 into the internal bore 217 of the body portion 213. The projectile then passes through opening 304 in annular wall 302, continues through internal bore 217 and ultimately exits the muzzle brake through opening 232 in nose portion 212.

As discussed above, some of the propellant gas generated from firing the firearm are redirected by annular wall 302, and/or projections 270*a*, 270*b*, 300*a*, or 300*b*. Those propellant gases that make it through annular wall 302 (through opening 304) and past the projections 270*a*, 270*b*, 300*a*, and 300*b* toward the nose portion 212, can encounter interior, rear surface 296 of annular depressed region 230. Interior, rear surface 296 of annular depressed region 230 creates turbulence in those propellant gases as they continue to travel along the internal bore 217 of body portion 213 toward opening 232 through which the projectile exits the muzzle brake. This turbulence acts to further reduce or neutralize recoil of the firearm as discussed above.

As further shown in FIG. 19, both the rear interior surface 296 and exterior, front surface 299 of the annular depressed region 230 are depressed, providing a generally concave profile to the exterior, front surface 299 of annular depressed region 230, and a generally convex profile to the interior, rear surface 296 of annular depressed region 230. The concavity of the exterior, front surface 299 of annular depressed region 230 helps to avoid sharp angles or edges around opening 232. As discussed above, the convexity of the rear interior surface 296 of annular depressed region 230 captures exploding, propellant gases that would otherwise exit the front of the muzzle through opening 232, and creates turbulence in those gases, thereby reducing recoil/kick of the firearm. In some embodiments of the present disclosure the shape of the concavity of the exterior, front surface 299 is bowl-shaped. Similarly, in some embodiments, the convexity of rear interior surface 296 is bowl-shaped. In other embodiments the shape of the concavity of the exterior, front surface of the annular depressed region and/or the shape of the convexity of the interior, rear surface of the annular depressed region is/are approximately conical or frusto-conical.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A muzzle brake for a firearm comprising:

a nose at a front end of the muzzle brake;

a mounting portion at a back end of the muzzle brake;

a body portion between the nose and the mounting portion that tapers towards the nose, the body portion comprising an internal bore and a plurality of gas vents, wherein the body portion comprises a longitudinal axis along the internal bore, and wherein the body portion further comprises a top surface and an opposite bottom surface; and a plurality of projections, wherein each projection of the plurality of projections extends outward from the body portion and each projection of the plurality of projections extends circumferentially around a section of the body portion, wherein the section is a partial circumference of the body portion, wherein each of the projections extends from the body portion of the muzzle brake at an angle with the longitudinal axis in a direction at least partially toward the back end of the muzzle brake, and wherein the top and bottom surfaces are each at least partially defined between the plurality of projections such that a circumferential width of the top surface is less than a circumferential width of the bottom surface.

2. The muzzle brake of claim 1, wherein each of the gas vents comprises a front side, and each of the plurality of projections extends from the front side of each of the plurality of gas vents.

3. The muzzle brake of claim 1, wherein the nose comprises an opening through which a projectile exits the muzzle brake, the nose further comprising a depressed annular region surrounding the opening, wherein the depressed annular region comprises a convex interior surface formed at an acute angle with an interior surface of the internal bore.

4. The muzzle brake of claim 1, wherein the angle is in a range from about 45° to about 70°.

5. The muzzle brake of claim 4, wherein the angle is about 60°.

6. The muzzle brake of claim 1, wherein the projections further extend in an upward direction toward the top surface of the body portion.

7. The muzzle brake of claim 1, wherein the body portion comprises two gas vents, and the top surface of the body portion between the two gas vents is narrower than the bottom surface of the body portion between the two gas vents.

8. The muzzle brake of claim 1 wherein each of the gas vents is approximately rectangular in shape.

9. The muzzle brake of claim 1, wherein the body portion comprises two gas vents, wherein each of the two gas vents is defined by a frame comprising a top frame member, a bottom frame member, and a back frame member behind the gas vent, the back frame member being angled outward from the body portion of the muzzle brake.

10. The muzzle brake of claim 9, wherein each of the plurality of projections extends outward from the body portion at a first angle, and wherein the back frame member is angled outward from the body portion at a second angle, the second angle being less than or equal to the first angle.

11. A muzzle brake comprising:

a nose at a front end of the muzzle brake, the nose comprising a depressed surface interior to the muzzle brake;

a mounting portion at a back end of the muzzle brake;

a body portion between the nose and the mounting portion that tapers towards the nose, the body portion comprising a substantially hollow internal bore and a plurality of gas vents, each of the plurality of gas vents being defined by a frame comprising a top frame member, a bottom frame member, and a back frame member behind the gas vent, the back frame member extending outward from the body portion and being angled toward the back end of the muzzle brake, wherein the depressed surface comprises a convex interior surface formed at an acute angle to an interior surface of the hollow internal bore; and a plurality of projections, each of the plurality of projections extending outward from the body portion and extending circumferentially around a section of the body portion, wherein the section is a partial circumference of the body portion.

12. The muzzle brake of claim 11, wherein the body portion comprises two gas vents, and a top surface of the body portion between the two gas vents is narrower than a bottom surface of the body portion between the two gas vents.

13. The muzzle brake of claim 11, wherein each of the plurality of projections extends outward from the body portion at a first angle, and wherein the back frame member is angled outward from the body portion at a second angle, the second angle being less than or equal to the first angle.

14. The muzzle brake of claim 11, wherein the acute angle is in a range from about 70° to about 80°.

15. The muzzle brake of claim 14, wherein the acute angle is about 75°.

16. The muzzle brake of claim 11 comprising at least four projections extending outward from the body portion, and an annular wall disposed between the nose and the mounting portion, wherein each of a pair of the at least four projections also extends outward from opposing sides of the annular wall.

17. The muzzle brake of claim 1, wherein the nose, mounting portion, body portion, and plurality of projections are unitarily formed of a single piece.

18. The muzzle brake of claim 11, wherein the nose, mounting portion, and body portion are unitarily formed of a single piece.

19. A firearm comprising the muzzle brake of claim 1.

20. A firearm comprising the muzzle brake of claim 11.

21. The muzzle brake of claim 1, wherein the body portion further comprises an annular shoulder extending radially outward therefrom and each gas vent extends along the longitudinal axis between each respective projection and the annular shoulder, wherein each projection extends radially outward to an extension that is less than or equal to the annular shoulder extension.

22. The muzzle brake of claim 11, wherein the body portion further comprises an annular shoulder extending radially outward therefrom and each gas vent extends axially between each respective projection and the annular shoulder, wherein each projection extends radially outward to an extension that is less than or equal to the annular shoulder extension.

* * * * *